United States Patent [19]

Guala

[11] 4,372,456

[45] Feb. 8, 1983

[54] SECURITY CLOSURE FOR BOTTLES

[75] Inventor: Piergiacomo Guala, Alessandria, Italy

[73] Assignee: Angelo Guala S.p.A., Corso Romita, Italy

[21] Appl. No.: 279,480

[22] Filed: Jul. 1, 1981

[30] Foreign Application Priority Data

May 28, 1980 [IT] Italy ..... 22366 A/80

[51] Int. Cl.[3] ..... B65D 41/34

[52] U.S. Cl. ..... 215/252

[58] Field of Search ..... 215/252

[56] References Cited

U.S. PATENT DOCUMENTS 3,455,478 7/1969 Fields et al. ..... 215/252

FOREIGN PATENT DOCUMENTS 2454273 5/1975 Fed. Rep. of Germany ..... 215/252

*Primary Examiner*—Donald F. Norton

*Attorney, Agent, or Firm*—Birch, Stewart, Kolasch & Birch

[57] ABSTRACT

The invention provides a security closure, particularly for single-measure bottles, of the type in which a screw cap is connected by breakable links to a ring engaged with a flange on the bottle neck. The lateral wall of the cap has at least one portion which is cut along its edges facing the rest of the wall and is connected to the ring by one or more breakable links only. When the cap is unscrewed and the links are broken the wall portions are completely detached and fall away from the cap so that, if the cap is subsequently screwed back into contact with the ring, the fact that the wall portions are missing will warn the consumer that the closure is broken.

5 Claims, 5 Drawing Figures

SECURITY CLOSURE FOR BOTTLES

BACKGROUND OF THE INVENTION

The present invention relates to a closure for bottles, particularly single-measure bottles for drinks such as liqueurs, aperitifs and bitters, of the type comprising a cap which is screwed on to a bottle neck, and a ring connected to the free edge of the cap by a number of small links which break when the cap is rotated and removed upon opening of the bottle, the ring being engaged with an annular flange on the outer surface of the bottle neck.

Closures of the aforesaid type are now well known in the art, and are usully moulded from plastics materials. They are used as security closures: when the links between the cap and the ring are intact, the consumer is assured that the closure has never been opened and that the drink in the bottle is genuine and fresh. After the initial opening, the broken links between the cap and the ring give visible proof that the closure has been tampered with. It has been noted in practice that, with this type of security closure, it is sometimes possible to rearrange the cap and ring against each other on the bottle neck to give an inattentive consumer the impression that the closure is still intact in spite of the broken links, allowing the bottle to be refilled fraudulently with a drink which is not genuine. This possible rearrangement is a serious disadvantage, particularly in relation to small single-measure bottles used in bars where the lighting does not always allow the consumer to evaluate and check the integrity of the safety closure adequately.

THE OBJECT OF THE INVENTION

The object of the present invention is to provide a safety closure of the aforesaid type which, once opened, will allow the consumer to ascertain immediately whether or not the closure is still intact. The problem fundamental to the invention is that of making the security closure in such a way that, after the initial opening, any possible rearrangements of the cap and ring on the bottle neck will not give the appearance of the unbroken outer surface of the adjacent parts and, therefore, of an apparently intact closure.

SUMMARY OF THE INVENTION

According to the present invention, a portion of the lateral wall of the cap adjacent the edge connected to the ring is separate from the remainder of the wall and is connected to the ring by at least one of the breakable links.

In a preferred embodiment, the wall portion of the cap is substantially trapezoidal in shape, having its smaller side facing the ring and connected to the latter by at least one of the links.

BRIEF DESCRIPTION OF THE DRAWINGS

The invention will now be more fully described, by way of example, with reference to the accompanying drawings, in which:

Referring to FIGS. 1 to 4, there is shown a security closure for a bottle, comprising a cap, generally indicated 1, and a ring 2 which are circular in cross-section and interconnected by a number of small links 3 which can be easily broken when the cap 1 is rotated and displaced axially relative to the ring 2. The whole closure is moulded in the conventional manner from a plastics material suitable for closures of this type.

Figure 1:
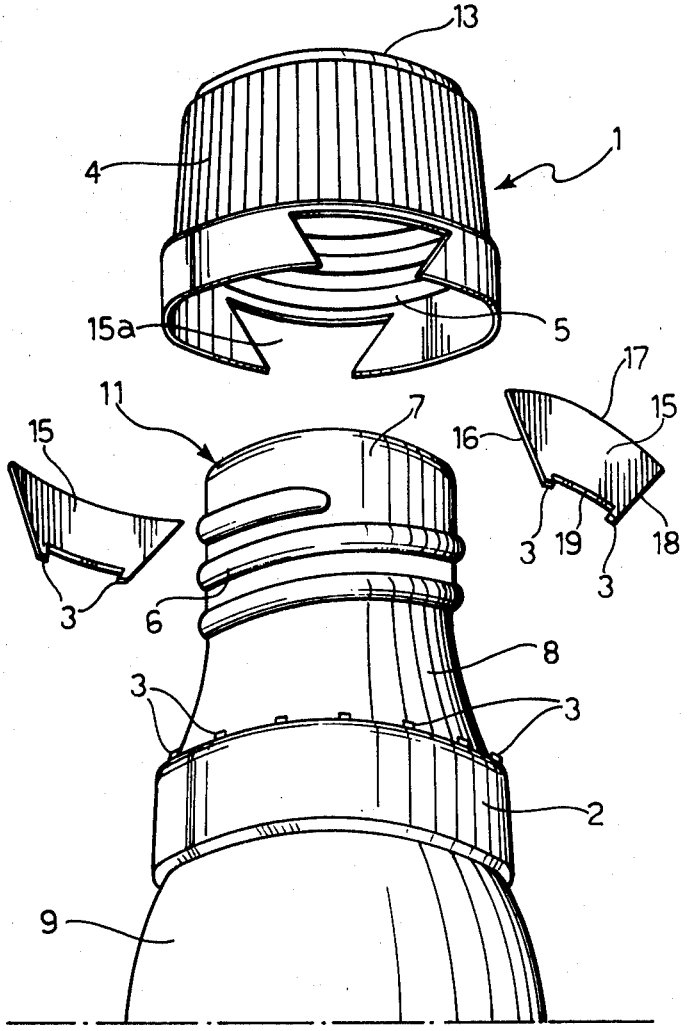
FIG. 1 is an exploded perspective view of a security closure according to a preferred embodiment of the invention, showing the cap in an open position relative to the neck of a single-measure bottle.
Figure 2:
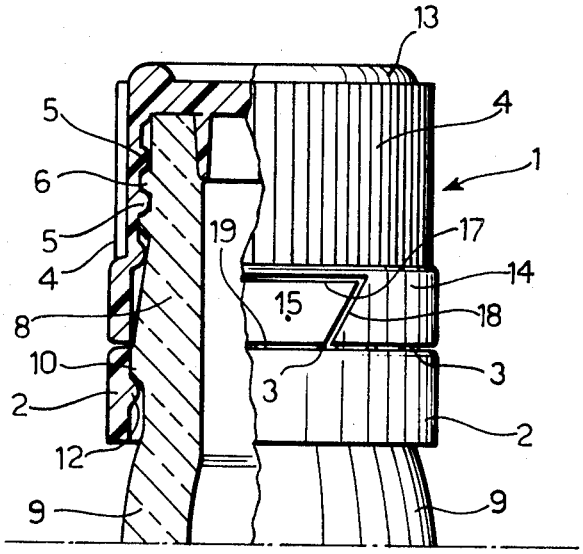
FIG. 2 is a partially-sectioned view of the closure in FIG. 1 assembled on the neck of the bottle.
Figure 3:
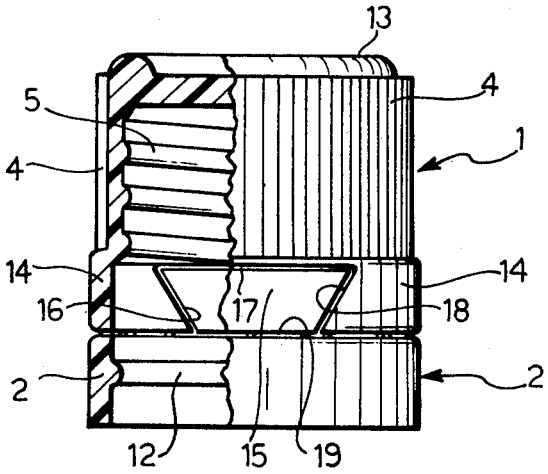
FIG. 3 is a side view of the closure of FIG. 1 partially in longitudinal section.

The cap 1 has a transverse end closure wall 13 and a substantially cylindrical side wall with a knurled outer lateral surface 4, which facilitates gripping and unscrewing of the cap 1, and a screw-threaded inner surface 5, for engagement with corresponding threads 6 on the outer surface 7 of the neck 8 of a bottle 9. In this example, the bottle 9 is of the single-measure type suitable for drinks such as, for example, bitters or aperitifs. The bottle neck 8 has an annular flange 10 adjacent its mouth 11, which is engaged by a ridge 12 on the inner wall of the ring 2.

In accordance with the invention, a zone 14 of the side wall of the cap adjacent the ring 2 is provided with an opposing pair of wall portions 15 which, in this preferred embodiment, are substantially trapezoidal in outline. Each portion 15 is completely separate from the remainder of the lateral wall along three sides 16, 17, 18 and is joined on to the ring 2 at its other side 19 by one or more of the links 3. In this embodiment, the smaller sides 19 of the trapezoidal portions 15 face the ring 2.

Figure 5:
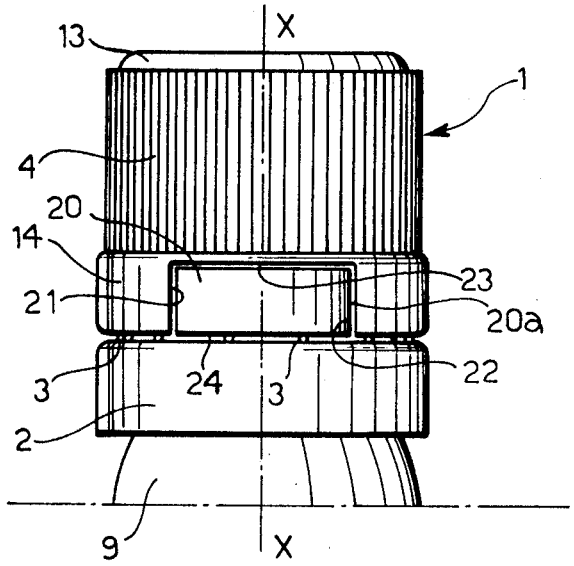
FIG. 5 is a side view of an alternative embodiment of the closure according to the invention.

With reference to FIG. 5, it can be seen that the cylindrical lateral wall of the cap 1 corresponding to the zone 14 has a pair of rectangular wall portions 20 which are equivalent to the portions 15 previously described. The shorter sides 21,22 of the portions 20 are parallel to the longitudinal axis X—X of the closure, and one of the larger sides 24 is joined to the ring 2 by one or more of the breakable links 3.

Figure 4:
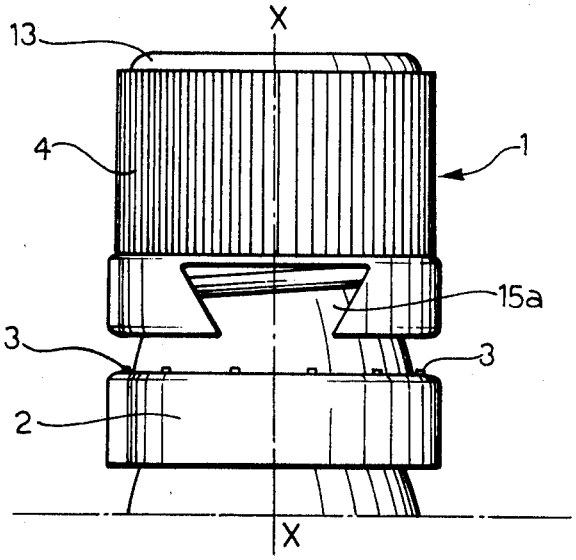
FIG. 4 is a side view of the closure of FIG. 1 after initial opening, showing the cap screwed back on to the neck of the bottle.

From the preceding description it will be appreciated that, when the bottle is first opened, a consumer rotates the cap 1 relative to the ring 2 to unscrew it from the threads 6 on the bottle neck 8. Since the ring 2 is anchored to the neck flange 10, this rotation breaks the links 3 and separates the cap 1 from the ring 2 which remains on the bottle neck 8, as shown in FIGS. 1 and 4. Continued unscrewing of the cap 1 until it is completely removed from the bottle neck 8, causes the respective opposing portions 15,20 (FIGS. 1 to 3 or FIG. 5) of the lateral wall to become detached from the closure and fall free, leaving corresponding spaces 15*a*, 20*a* on the free edge of the cap 1.

In the case of a fraudulently refilled bottle 9, any possible arrangement of the cap 1 against the ring 2, after the former has been screwed back on to the neck 8, would not give the appearance of a substantially continuous surface between the two parts due to the presence of the gaps 15*a*, 20*a* left by the detachment of the corresponding wall portions 15,20. These portions 15,20 are usually lost during the initial opening but, even if they are recovered, they could not be kept firmly in place to cover the respective gaps 15*a*, 20*a*, which will be clearly visible.

The consumer can therefore easily determine by sight or touch whether the bottle has an intact security closure ensuring original contents, or whether it has been tampered with or fraudulently refilled.

It will be appreciated that the preferred embodiment shown in FIGS. 1 to 4 has an advantage compared with the embodiment of FIG. 5 in that, during any attempt to break the links 3 solely by pulling the cap 1 axially, the links 3 between the wall portions 15 and the ring would be broken since the pulling would be transmitted to the portions 15 through the inclined sides 16,18 of the trapezoid. Thus, even in this case, complete breakage with detachment of the portions 15 will occur.

What is claimed is:

1. Security closure for a bottle having a neck with an annular flange adjacent its mouth and external screw-threading between the flange and the mouth, said closure comprising a cap with a lateral wall, which is screwed on to the bottle neck; a ring engaged with the annular flange of the neck, and a plurality of links interconnecting the ring and the free edge of the wall of the cap, said links being breakable when the cap is rotated and displaced axially relative to the ring upon opening of the bottle wherein the improvement consists in said lateral wall of the cap having at least one portion adjacent its free edge which is separate from the remainder of said wall and is connected to said ring by at least one of said breakable links.

2. Safety closure as defined in claim 1, wherein said portion of the lateral wall of the lateral wall of the cap is rectangular in shape.

3. Safety closure as defined in claim 1, wherein said portion of lateral wall of the cap is substantially trapezoidal in shape, having its smallest side facing the ring and joined thereto by said at least one link.

4. Safety closure as defined in claim 1, claim 2 or claim 3, wherein said lateral wall of the cap is provided with a diametrically opposed pair of said portions.

5. Safety closure as defined in claim 1, wherein said closure comprises a plastics moulding.

* * * * *